US005766266A

United States Patent [19]

Ripley et al.

[11] Patent Number: 5,766,266

[45] Date of Patent: Jun. 16, 1998

[54] METHOD OF LASER CLEANING AND BLEACHING A FIBER WEB

[76] Inventors: William G. Ripley, 4218 88th St., Lubbock, Tex. 79423; David A. Ripley, 2702 Genoa #A1, Lubbock, Tex. 79404

[21] Appl. No.: 834,087

[22] Filed: Apr. 14, 1997

Related U.S. Application Data

[62] Division of Ser. No. 642,455, May 3, 1996, Pat. No. 5,699,589.

[51] Int. Cl.[6] ..... D06L 3/04

[52] U.S. Cl. ..... 8/103; 8/102; 8/115.52; 8/115.53; 8/444; 19/98; 19/296; 19/299; 19/161.1

[58] Field of Search ..... 8/103, 102, 115.53, 8/115.52, 444; 19/98, 296, 299, 161.1

[56] References Cited

U.S. PATENT DOCUMENTS

| | | | |
|---|---|---|---|
| 3,536,528 | 10/1970 | Geest | 134/1 |
| 3,668,091 | 6/1972 | French et al. | 204/156 R |
| 4,150,461 | 4/1979 | Leifeld | 19/200 |
| 4,158,555 | 6/1979 | Kallenborn | 65/2 |
| 4,792,341 | 12/1988 | Kozikowski et al. | 8/103 |
| 4,953,365 | 9/1990 | Lang et al. | 62/381 |
| 5,098,447 | 3/1992 | Zucchini et al. | 8/103 |
| 5,199,134 | 4/1993 | Ripley | 19/66 CC |
| 5,246,019 | 9/1993 | Godfrey et al. | 8/115.52 |
| 5,253,392 | 10/1993 | Ripley | 19/65 A |
| 5,407,446 | 4/1995 | Sando et al. | 8/103 |
| 5,425,158 | 6/1995 | Ripley | 19/66 CC |
| 5,567,207 | 10/1996 | Lockman et al. | 8/444 |

OTHER PUBLICATIONS

A.J. Hall, The Standard Handbook of Textiles, p. 235. (Month unknown), 1975.

*Primary Examiner*—Alan Diamond
*Attorney, Agent, or Firm*—Cort Flint; Henry S. Jaudon

[57] ABSTRACT

A method and apparatus for bleaching and cleaning fibers of a fiber web. The method and apparatus includes continuously forming and moving a fiber web through a bleaching and cleaning station. Directing ultraviolet light onto the surface of the fiber web forming a bleaching and cleaning line. Selecting an intensity and frequency for the ultraviolet light sufficient to separate micro trash and dust from the fibers while simultaneously destroying pigment of the fibers. Collecting and removing the micro dust and trash while conveying the fiber web to subsequent fiber processing apparatus.

7 Claims, 2 Drawing Sheets

METHOD OF LASER CLEANING AND BLEACHING A FIBER WEB

This is a divisional of application Ser. No. 08/642,455 filed on May 3, 1996 now U.S. Pat. No. 5,699,589.

BACKGROUND OF THE INVENTION

This invention relates to a method and apparatus for bleaching or lightening cotton fibers while simultaneously causing micro dust and trash from the fibers.

During the processing of natural fibers, particularly cotton fibers, the cleaning and bleaching processes require large and expensive pieces of equipment which utilize large expanses of spaces. During operation these machines utilize large quantities of costly chemicals and water in carrying out the bleaching process which results in costly water treating processes.

The instant invention has as its objects the elimination or at least a reduction in the equipment and materials utilized in the cleaning and bleaching process of natural fibers.

Another object of the invention is the reduction in the use of chemicals and water necessary to provide clean and processable webs.

Another object of the invention is the reduction of chemical waste into the ecosystem.

Another object of the invention is a reduction in the consumption of power used for cleaning and bleaching fiber webs.

Another object of the invention is the removal of micro dust and trash from fiber webs.

Another object of the invention is the use of ultraviolet light to strip away micro dust and trash from natural fibers forming fiber webs and to bleach these fibers by destroying their natural pigmentation.

Another object of the invention is to preform a bleaching and cleaning operation of the fibers forming a fiber web without physically effecting or altering the structure of the fiber web.

SUMMARY OF THE INVENTION

The invention is directed to a fiber web bleaching and cleaning arrangement which is operative to remove micro dust and minute trash from the fibers of a moving fiber web while simultaneously bleaching the fibers. The arrangement includes a conveying apparatus for conveying a fiber web between first and second locations and a support structure arranged adjacent the conveying apparatus which supports the fiber bleaching and cleaning apparatus. The support includes a micro dust and trash removal apparatus which receives and carries off the micro dust and trash as it is separated from the fiber web.

The conveying apparatus may comprise a carding machine which forms and feeds a fiber web from a first location and a web receiving apparatus which receives the fiber web at a second location.

The bleaching and cleaning apparatus is located between the first and second location. It may comprise a single bank of ultraviolet lasers which are operative to direct ultraviolet light beams onto the fiber web or it may consist of a plurality of laser banks each directing ultraviolet light beams onto the fiber web. The banks of ultraviolet lasers are arranged transversely of the fiber web. Preferably, there are at least two banks of ultraviolet lasers with at least one of them being arranged beneath the fiber web. The beams of ultraviolet light are directed onto the fiber web along an acute angle and impinge upon the fiber web along a transverse line identified as the cleaning and bleaching line.

Each of the ultraviolet banks comprise a plurality of laser assemblies which emit the high intensity ultraviolet light beams. Each of the laser assemblies includes a laser tube and a plurality of co-operating mirrors. The mirrors are arranged to receive a laser beam from the laser tube and to redirect the laser beam onto the fiber web. A drive is connected with each mirror. The drives sequentially oscillates the mirrors to cause at least that portion of the laser beam contacting the fiber web to move through a circular or elliptical pattern on the fiber web. The mirrors are arranged so that adjacent circular or elliptical patterns overlap where they contact the fiber web to form a continuous line across the width of the web.

The micro dust and trash removal apparatus includes a transporting belt and a removal duct which collect and remove the debris. The belt is arranged beneath the bleaching and cleaning line and the fiber web.

A method of bleaching fibers of a fiber web which includes continuously forming a web of fibers and moving the web through a bleaching station. The method includes directing beams of high intensity ultraviolet light onto the fiber web along a bleaching line and causing the beams of ultraviolet light to be of an intensity and frequency to bleach the fibers by destroying at least some pigmentation thereof. The method also includes providing that the frequency and intensity of the beams of ultraviolet light is sufficient to cause micro trash and dust to fall away from the fibers and out of the fiber web. The method further includes providing a removal system beneath the bleaching and cleaning line which receives and removes the falling micro dust and trash.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
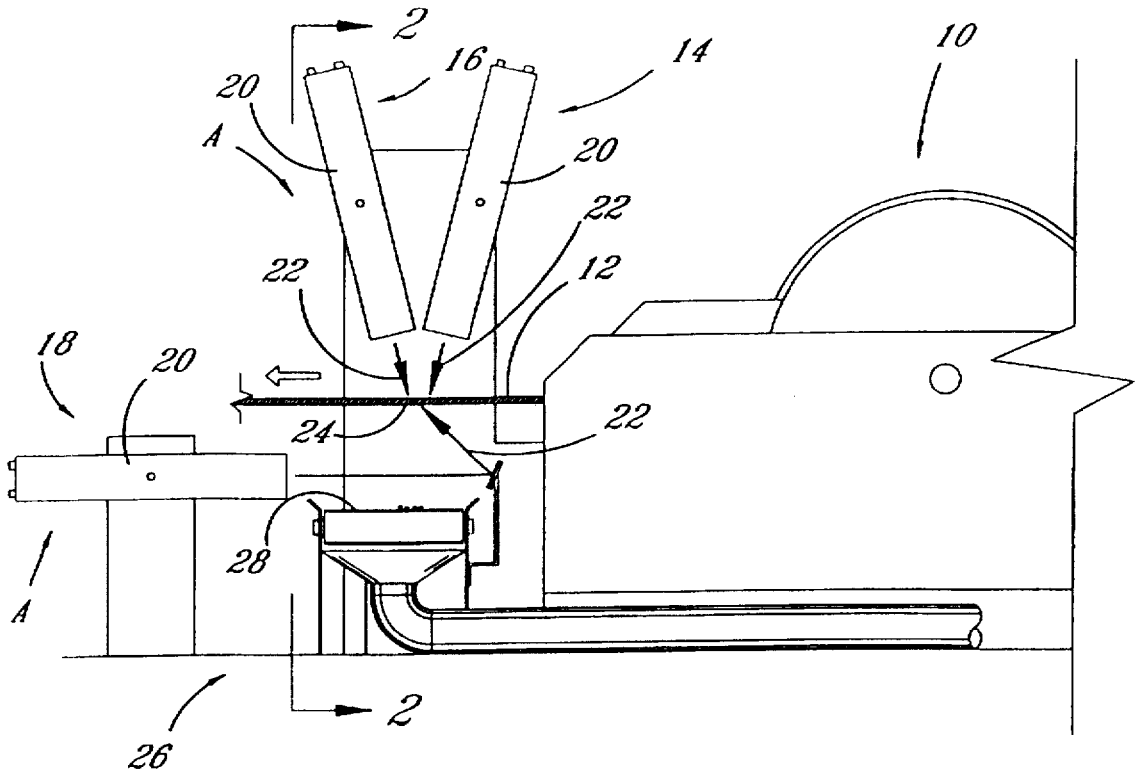
FIG. 1 is a schematical side view showing the bleaching and cleaning apparatus of the invention associated with a carding machine.
Figure 2:
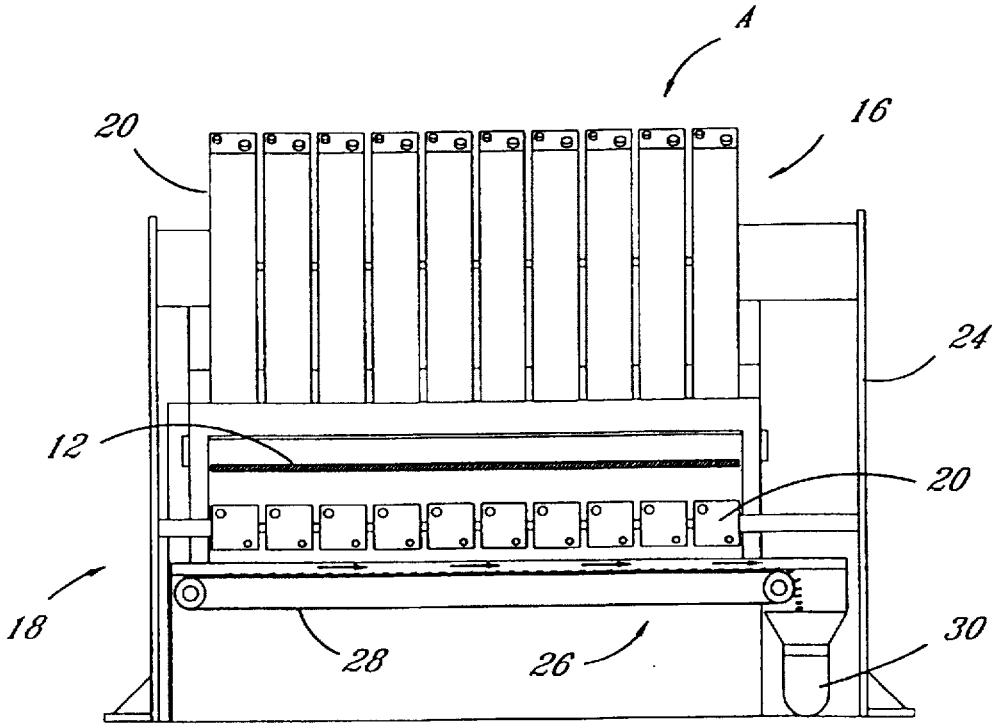
FIG. 2 is an end view taken along line 2—2 of the arrangement shown in FIG. 1.

Turning now to the drawings, a preferred embodiment of the invention is shown in FIGS. 1 and 2. Carding machine 10 is shown delivering a carded web 12 through bleaching and cleaning device A as it is passed continuously to further processing stations, not shown. The arrangement, as shown in FIG. 1, includes three banks of lasers 14, 16, and 18. It is noted that while this is the preferred arrangement and it is possible and within the scope of this invention to use as few as one and as many as six banks of lasers.

Each bank of lasers 14, 16, or 18 is comprised of a plurality of laser assemblies 20, with each assembly being operative to deliver a single beam of ultraviolet light 22. Laser assemblies 20 are arranged side-by-side and parallel between support frame structures 24 in desired positions above and below moving fiber web 12. The beams of ultraviolet light 22 are preferably arranged transversely of fiber web 12 and at an acute angle to the longitudinal surface of the fiber web 12. In this position, the beams of ultraviolet light engage the surface of fiber web 12 along bleaching line 24.

A dust and trash removal system 26 is located beneath bleaching and cleaning line 24 in position to receive the dust and micro trash as it is separated from fiber web 12 by the action of the beams of ultraviolet light 22. Dust and micro trash removal system 26 includes a continuously rotating conveyor 28 mounted beneath and parallel bleaching line 24. Located adjacent one end of rotating conveyor 28 is a vacuum line 30 which receives the trash from the conveyor and delivers it to a suitable trash storage area, not shown.

Figure 3:
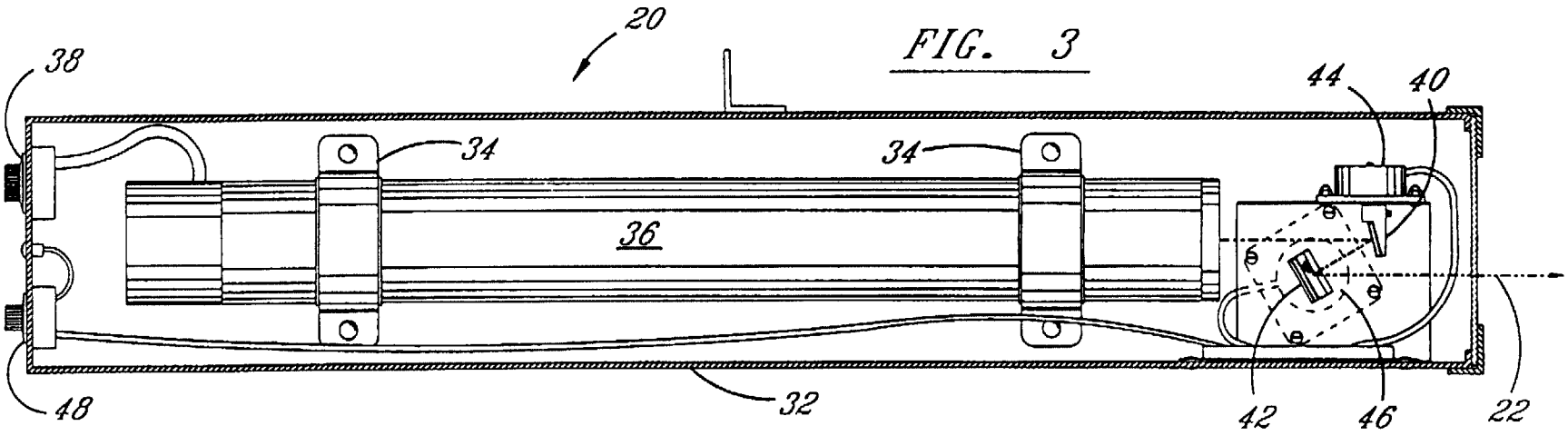
FIG. 3 is detailed sectional side view of a laser assembly.

Each laser assembly 20, as best shown in FIG. 3, includes a housing 32 which houses a laser tube 36. The laser tube 36 is mounted by suitable mounting apparatus such as brackets 34, within housing 32. Power is supplied to laser tube 36 through variable control 38 which allows the strength of the laser beam 22 to be adjusted as desired.

Arranged adjacent the opposite or beam emitting end of laser tube 36 are mirrors 40 and 42. Mirror 40 is arranged to receive laser beam 22 and deflect it at an approximate 450 angle back and onto mirror 42. Mirror 42 then redirects beam 22 forwardly in generally its original direction.

Figure 4:
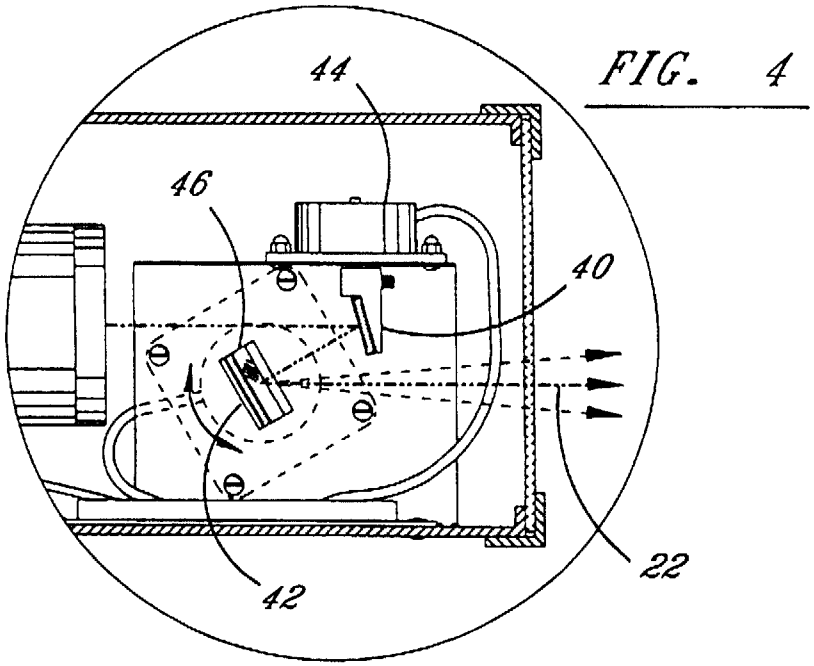
FIG. 4 is an exploded sectional view of the right end portion of the laser assembly of FIG. 3.

Mirrors 40, 42 are connected with step motors 44, 46 through a known transmission system. Step motor 44 moves mirror through an oscillating motion which causes laser beam 22 to move across the face of mirror 42 with a left to right motion. Mirror 42 is driven by step motor 46 in an up and down oscillating motion as indicated by the arrow in FIG. 4. The motion of mirror 42 causes the laser beam 22 to move in an up and down motion.

Figure 5:
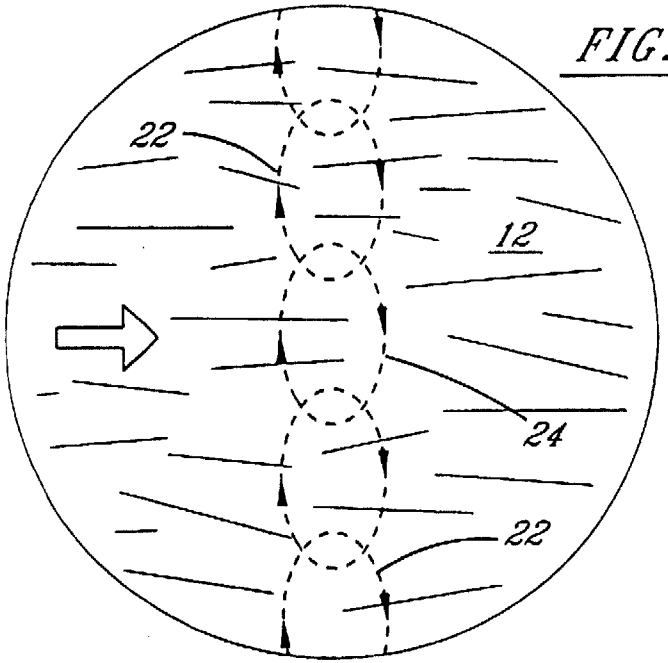
FIG. 5 is a sectional top view of the laser beams impinging the surface of the fiber web.

The combination of the motions of mirrors 40, 42 causes each laser beam 22 to move through an elliptical or circular motion where it contacts with the surface of fiber web 12 along bleaching and cleaning line 24. As shown in FIG. 5, each laser beam 24 moves through an elliptical path with adjacent edges of each elliptical pattern overlapping to provide for complete and continuous engagement of the laser beams 22 with the surface of fiber web 12 along bleaching and cleaning line 22. It is noted that the path through which each laser beam moves can be controlled to be from circular to substantially linear by selecting the proper angle for mirrors 40, 42 and controlling the arc of oscillation delivered by step motors 44, 46. Adjacent laser beams 22 may be controlled to rotate in opposite directions. An oval configuration as shown in FIG. 5 is preferred.

The speed at which mirrors 40, 42 oscillate is controlled by rheostat 48 and is dependent upon the speed at which the fiber web moves past bleaching and cleaning line 24 and the intensity of the laser beams.

In practice, it is preferred that a one watt laser tube producing a laser beam having a wave length of approximately 0.53 μm is employed. Of course, the tube, the wave length, and the frequency could be larger or smaller as determined to be most desirable and depending on the degree of cleaning and bleaching desired. Laser tubes ranging between 250 MW to 500 (MIC/WATT) and capable of producing laser beams having wave lengths between 1.04 μm to 1.96 μm with ultra sonic frequency.

In operation, fiber web 12 exits carding machine 12 at a normal rate of speed and is passed through cleaning station A, where a beam or beams of ultraviolet light 22 engages with the fibers of fiber web 12 along a transverse bleaching line 24. The ultraviolet light is of sufficient frequency to literally strip micro trash and dust from the fibers while at the same time destroying pigmentation or bleaching the fibers. The removed micro trash and dust fall from web 12 onto conveyor 28 which carries it from the area. Web 12 continues uninterrupted on to a subsequent finishing operation. Care must be taken to insure that the fiber web is not over heated or scorched.

The disclosed bleaching and cleaning device may also be utilized to bleach and clean webs formed in hydroentangling lines or with any other apparatus producing non-woven fiber webs.

While a preferred embodiment of the invention has been described using specific terms, such description is for illustrative purposes only, and it is to be understood that changes and variations may be made without departing from the spirit or scope of the following claims.

What is claimed is:

1. A method of uniting fibers into a fiber web and bleaching said fibers of said fiber web comprising:

passing said fibers through a carding machine forming a web of fibers and moving said fiber web through a bleaching station in continuous sequence;

directing beams of high intensity ultraviolet light onto and across said fiber web along a single bleaching line; and causing said beams of ultraviolet light to be of an intensity and frequency sufficient to bleach said fibers by destroying at least some pigmentation thereof.

2. The method of claim 1 including providing said beams of ultraviolet light with an intensity sufficient to cause micro dust and trash present in said fiber web to separate from said fibers and fall from said fiber web along said bleaching line during the bleaching process and transporting the removed micro dust and trash away from said fiber web.

3. The method of claim 1 including moving said fiber web through said bleaching line at a rate normal to the discharge rate of said carding machine.

4. A method of bleaching and cleaning loose, dry fibers entangled to form a fiber web comprising:

forming said fiber web at a forming station by entangling individual dry fibers;

moving said fiber web formed of said dry fibers from said forming station through a bleaching and cleaning station;

directing laser beams onto said fiber web during passage through said bleaching and cleaning station with an intensity sufficient to vibrate and separate micro dust and trash from said dry fibers forming said fiber web and to destroy at least some pigmentation of said dry fibers forming said fiber web, whereby;

said dry fibers forming said fiber web are readied for further fiber preparation.

5. The method of bleaching fibers forming a fiber web comprising:

forming a web of loose fibers at a forming station and moving said web directly from said forming station through a bleaching station;

directing high intensity ultraviolet laser beams onto said web and said fibers along a bleaching line within said bleaching station;

bleaching said fibers forming said web by causing said beams to be of an intensity and frequency sufficient to destroy some pigmentation of said fibers; and, ausing each of said beams to move about said bleaching line along a repetitive path, said paths followed by said beams assisting in preventing fiber damage due to overheating.

6. The method of claim 5, causing adjacent limits of said paths to overlap.

7. The method of claim 5, providing that each of said paths are one of circular, elliptical, and linear.

* * * * *